US005159800A

United States Patent [19]

Gianelli

[11] Patent Number: 5,159,800

[45] Date of Patent: * Nov. 3, 1992

[54] BAG OPENING DEVICE

[75] Inventor: Gian C. Gianelli, Milan, Italy

[73] Assignee: W. R. Grace & Co.-Conn., Duncan, S.C.

[ * ] Notice: The portion of the term of this patent subsequent to Jan. 1, 2008 has been disclaimed.

[21] Appl. No.: 574,326

[22] Filed: Aug. 28, 1990

Related U.S. Application Data

[63] Continuation of Ser. No. 176,827, Apr. 4, 1988, Pat. No. 4,981,009.

[30] Foreign Application Priority Data

Sep. 22, 1987 [GB] United Kingdom ..... 8722202

[51] Int. Cl.[5] ..... B65B 43/26

[52] U.S. Cl. ..... 53/492; 53/459

[58] Field of Search ..... 53/50, 384, 385, 459, 53/469, 473, 492, 570, 571, 572, 573, 567, 568, 384.1, 385.1

[56] References Cited

U.S. PATENT DOCUMENTS

| | | | |
|---|---|---|---|
| 2,851,838 | 9/1958 | McIntyre et al. | 53/385 |
| 3,754,370 | 8/1973 | Hanson | 53/385 X |
| 4,514,962 | 5/1985 | Ausnit | 53/384 |
| 4,516,384 | 5/1985 | Imperiale | 53/459 |
| 4,561,238 | 12/1985 | Odom | 53/573 |
| 4,567,715 | 2/1986 | Sawa et al. | 53/385 X |
| 4,586,319 | 5/1986 | Ausnit | 53/384 X |
| 4,795,413 | 1/1989 | Johnson et al. | 53/384 X |

FOREIGN PATENT DOCUMENTS

| | | |
|---|---|---|
| 3326616 | 1/1985 | Fed. Rep. of Germany . |
| 1046982 | 10/1966 | United Kingdom . |
| WO88/05403 | 7/1988 | World Int. Prop. O. . |

*Primary Examiner*—John Sipos
*Assistant Examiner*—Linda B. Johnson
*Attorney, Agent, or Firm*—William D. Lee, Jr.; Jennifer L. Skord; Mark B. Quatt

[57] ABSTRACT

Apparatus for the opening of a bag 1 is provided with a clamp 2 having one fixed jaw 3 which applies a high pressure to a limited area of the bag by means of a pip 4, and a movable jaw 5 which applies a lower pressure to the bag 1 over a larger area through a spring-loaded block 6 and a rubber pad 7, and is movable by means of a pneumatic cylinder 8. The high pressure applied by the pip 4 is sufficient to prevent any relative movement of the bag panels. The lower pressure exerted by the rubber pad 7 is sufficient to prevent sliding movement of the pad 7 relative to the upper surface of the bag 1 but does not prevent relative movement between the upper and lower panels of the bag 1. When the movable jaw 5 is moved towards the fixed jaw 3 a region of the upper panel of the bag is buckled between the two jaws. Raising of the clamp thus opens the bag, the lower side being held down by adhesive tape 9.

1 Claim, 3 Drawing Sheets

BAG OPENING DEVICE

This is a continuation application of application Ser. No. 176,827, filed on Apr. 4, 1988, now U.S. Pat. No. 4,981,009.

This invention relates to a method of and apparatus for opening and holding open a bag while an operation is carried out such as insertion of the product which the bag is intended to contain.

Packaging bags have in the past been opened, on an automatic or semi-automatic bag loader, by inflation using an air jet blown from below the product feed surface. However, the act of introducing the product into the bag obstructs the jet temporarily and thus the bag is not always fully open to receive the product entering the bag mouth.

Previously it has been known from U.S. Pat. No. 4,516,384 to open bags, that is to separate the bag walls at the bag mouth, by applying a rotatable rubber-faced wheel or roller to the top panel, rotating the rubber wheel causing the bag panels to separate either side of the rubber wheel, and inserting spreader bars which can then be used to open the bag. U.S. Pat. No. 4,516,384 also discloses bag opening apparatus comprising a support frame carrying two resilient rubber fingers which, in the relaxed state extend downwardly convergently towards a bag, but do not contact each other. The frame is lowered so that the fingers touch the upper surface of the bag. As the support frame is lowered farther, the rubber fingers are bent towards each other, until, due to the frictional contact between the fingers and the bag, a buckle of bag material is gripped between them ready to receive one of two spreader bars. This, however, is unsatisfactory in that varying bag stiffnesses (e.g. resulting from a multi-function laminated bag such as a bag having an oxygen barrier layer and a bone guard layer), and other mechanical parameters of the bag make the apparatus inefficient and unreliable often causing both bag panels to be gripped together. Air inflation is also ineffective in such cases.

According to one aspect of the present invention there is provided apparatus for opening a bag comprising a clamp having a fixed jaw and a movable jaw, the jaws being such that when the clamp is lowered onto a bag, the fixed jaw exerts a higher pressure on the bag than the movable jaw such that when the movable jaw is moved towards the fixed jaw, a region of the upper panel of the bag is buckled between the two jaws and may be gripped by the clamp by pinching.

According to a second aspect of the invention there is provided a method of opening a bag comprising the steps of applying a higher pressure to a first region of an upper panel of the bag and applying a lower pressure to a second region of the bag; dragging the part of the bag where the lower pressure is applied towards the part where the higher pressure is applied, thereby causing a region of the upper panel of the bag between the two parts to buckle, and pinching and lifting said buckled region to lift the upper panel of the bag, so opening the bag.

The use of one stationary high pressure jaw permits that bag-engaging jaw to serve as a movement stop on any vertical movement of the clamp, thereby allowing a precise position of the movable jaw to be established relative to the bag and hence an accurate control of the bag/jaw friction at the movable jaw to be maintained in order to ensure sliding of the top panel relative to the lower panel of that bag.

In order that the present invention may more readily be understood the following description is given, merely by way of example, with reference to the accompanying drawings in which.

Figure 1:
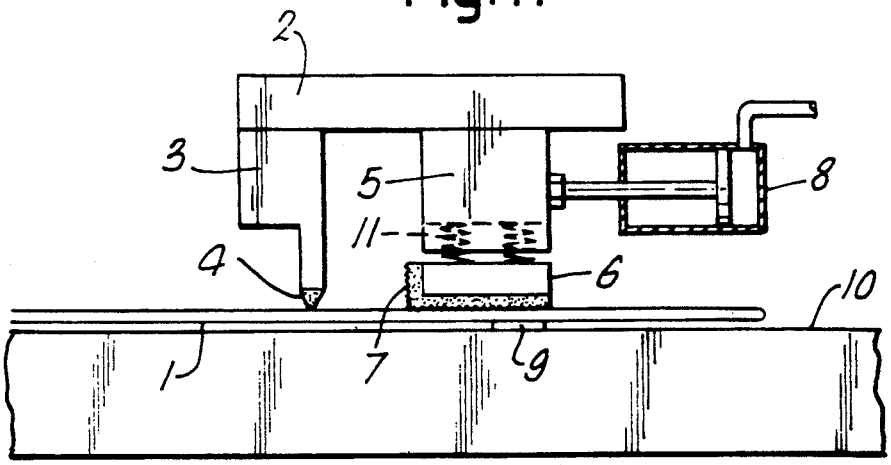
FIG. 1 is a side view of a bag-engaging clamp of the apparatus of the present invention.

FIG. 1 shows one of two vertically movable clamps 2 of bag-opening apparatus of the present invention having one fixed jaw 3 and a second movable jaw 5. The fixed jaw 3 contacts the top panel of the bag 1 over a small area in order to maximise the pressure applied for a given downward force. Preferably the fixed jaw 3 is provided with a pip 4 in order that the contact area with the top panel is minimised. The movable jaw 5 is provided with a spring-loaded block 6 at the base of which is mounted a pad 7 of rubber or other high friction material which may preferably have a serrated or other profiled lower surface.

The base of the movable jaw 5 contacts the upper panel of the bag over a larger area than the pip 4 and thus exerts a lower pressure for said given downward force. The movable jaw 5 is movable laterally, towards and away from the fixed jaw 3, by means of a pneumatic cylinder 8.

The bag 1 may be one of a plurality of bags formed of a taped imbricated bag chain or alternatively the top bag of a stack of wicketed bags, or the leading bag of a chain of side-sealed bags. In the latter case there may be a single clamp 2 which may also be used to index the chain as the leading bag is opened.

Figure 2:
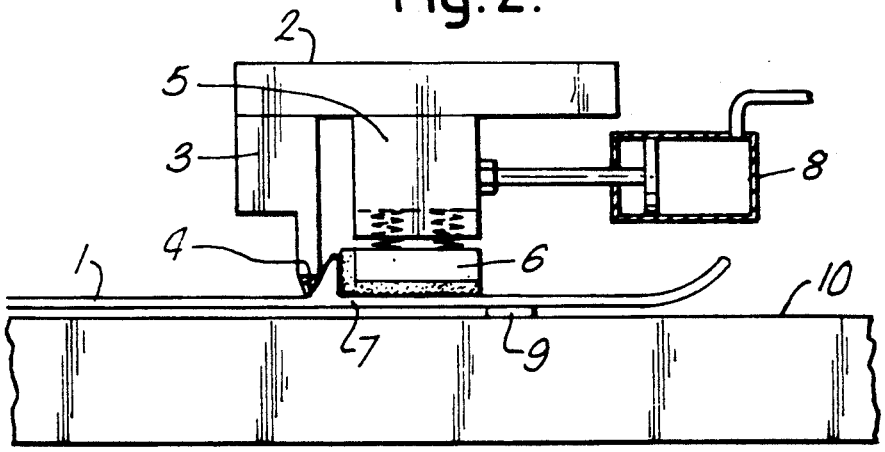
FIG. 2 is a side view of the clamp pinching an upper bag panel.
Figure 3:
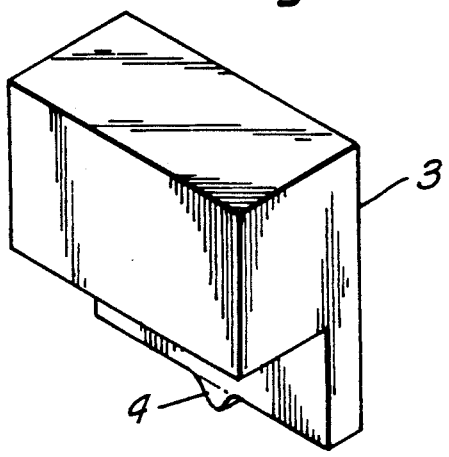
FIG. 3 is a perspective view of the fixed jaw of the clamp.

The bag 1 rests on a base 10. In order to grip the upper panel of the bag 1 the clamp 2 is lowered onto the bag 1 so that the pip 4 located on the fixed jaw 3 and the high friction rubber base 7 of the movable jaw 5 both press onto the bag. The high pressure applied by the pip 4 is sufficient to prevent movement of the two bag panels relative to each other or relative to the base 10. In any case the friction between the lower bag panel and the base, and also the tension in the tapes 9, serve to hold the bottom panel flat. The lower pressure exerted by the movable jaw 5 prevents relative movement between the rubber base 7 and the upper bag panel, but does allow for relative movement between the two bag panels. Thus when the movable jaw 5 is moved towards the fixed jaw 3, a region of the upper bag panel buckles upwardly between the two. This buckle is then pinched between the fixed jaw 3 and the movable jaw 5, as shown in FIG. 2. Preferably, the base 10 is made of hard rubber in order that the bag bending effect at the pressure point of pip 4 is enhanced.

The achievement of a reduced contact area at the fixed jaw 3 may be by way of the pip 4, or by any other means such as a "line contact" knife edge on the jaw undersurface.

A complete bag opening operation will now be described with reference to the drawings. .

Figure 4:
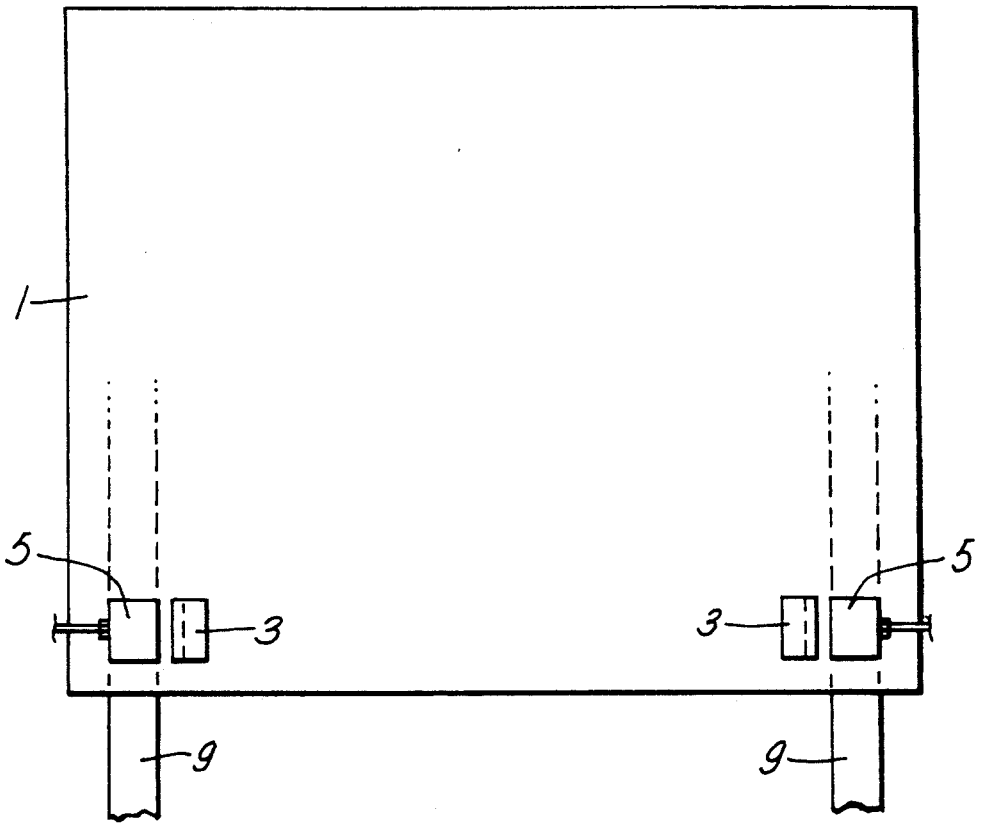
FIG. 4 is a top plan view of the apparatus.
Figure 5:
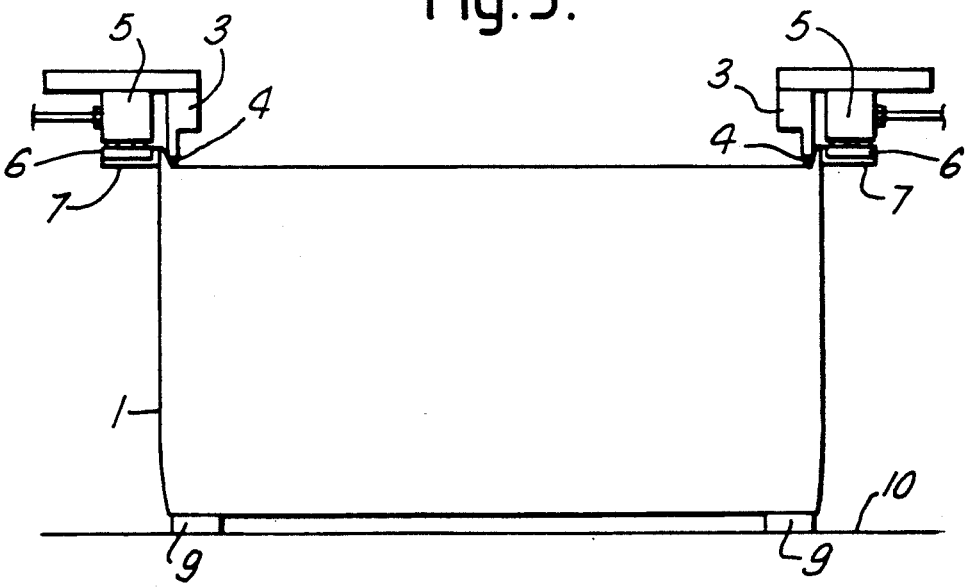
FIG. 5 is a front view showing the apparatus with the bag held open.

The two clamps 2 of the apparatus are lowered onto the upper surface of the bag 1 near its mouth, preferably each positioned just within the tapes 9 as shown in FIG. 4. Each clamp 2 then executes the pinching operation described above in order each to pinch a buckle of the upper panel of the bag 1. The clamps 2 are then subsequently raised in order to open the bag. The lower panel of the bag 1 is held down onto the base 10 by means of the adhesive tapes 9. The opened bag is shown in FIG. 5. The product which the bag is intended to contain can then easily be inserted through the opening formed. Thus the invention allows for products such as foodstuffs to be readily packaged in bags for example by an operator-free automatic bag loader.

Although in the drawings and in the above description two clamps 2 are provided, and operated in unison, it is possible for only one clamp 2 to be used, or for more than two clamps to be provided. Where more than two are used there may be clamping of the bag both at or near the mouth and at one or more location between that clamping and the closed end of the bag. This could even be achieved by having a virtually continuous line of clamping along the bag or several such continuous lines laterally spaced on the bag. This is particularly useful for bags to contain fatty or boney products.

From the above description, it is clear that the present invention shows a definite improvement over the prior art, using the lower pressure applied by a movable jaw to ensure that only the upper panel of a bag is gripped.

Figure 6:
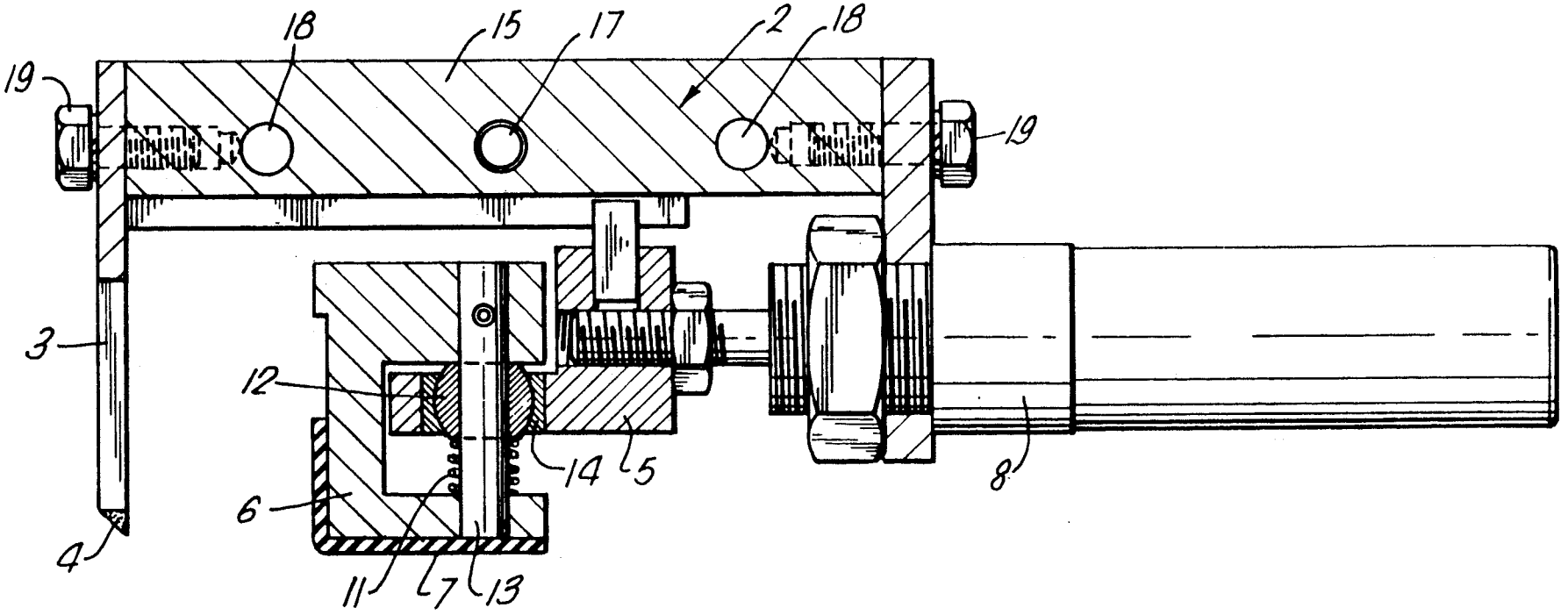
FIG. 6 is an elevation view in partial cross section of the fixed jaw and moveable jaw shown in FIG. 1.

Turning now to FIG. 6 the fixed jaw 3 and moveable jaw 5 of FIG. 1 are shown in partial section in order to appreciate the details of the mechanism. Moveable jaw 5 is provided with a passageway to its left hand side in which is press fitted an outer bushing ring 14 having an inner concave surface. Fitted into this concave surface is an inner bushing 12 through which passes support shaft 13 which is pinned in its upper portion to block 6. The lower part of shaft 13 is slideably mounted in the lower part of block 6 and spring 11 encircles the shaft 13 so that upon upward motion of block 6 spring 11 is compressed. This is the spring loaded feature of the moveable jaw.

Apertures 17 and 18 run horizontally through the upper part of clamp 2. Horizontal mounting or support rods are positioned within appertures 17 and 18 and slidably carry the clamp 2 so that it can be moved horizontally along the length of the bag whereby the clamp can be adjusted in its position over the mouth of a bag. Securing bolts 19 when tightened against the support rods hold the clamping jaw in place.

I claim:

1. A method of opening a flattened bag having upper and lower panels comprising the steps of: applying a first and higher pressure via a fixed jaw to a first region on one side of an upper panel of the bag and applying a second pressure lower than the first via a movable jaw to a second region on the same side of the upper panel of the bag, said movable jaw being transversely moveable towards and away from said fixed jaw and said fixed jaw being stationary with regard to transverse movement toward said movable jaw, said second region being transversely spaced apart along the bag mouth from the first region, moving the movable jaw transversely along the bag mouth toward the fixed jaw for dragging only transversely the part of the bag where the lower pressure is applied towards the part where the higher pressure is applied via the fixed jaw, during said moving and dragging step, maintaining said first region stationary to said fixed jaw and maintaining said second region stationary to said movable jaw thereby causing a region of the upper panel of the bag between the two parts to buckle and be gripped between said fixed jaw and said movable jaw, and pinching and lifting said buckled region with said fixed jaw and said movable jaw to lift the upper panel of the bag, and so opening the bag.

* * * * *